United States Patent [19]

Tomlinson et al.

[11] Patent Number: 4,658,442

[45] Date of Patent: Apr. 21, 1987

[54] WEIGHT VEST

[76] Inventors: Dick Tomlinson, 8935 Sinnard Ave., Live Oak, Calif. 95953; Michael Von Quilich, P.O. Box 67, San Ysidro, Calif. 92073

[21] Appl. No.: 794,478

[22] Filed: Nov. 4, 1985

[51] Int. Cl.[4] ..... A41D 1/00

[52] U.S. Cl. ..... 2/94; 2/102; 2/2.5; 272/119

[58] Field of Search ..... 2/94, 1, 102, 2, 2.5; 272/119, 70

[56] References Cited

U.S. PATENT DOCUMENTS

| | | | |
|---|---|---|---|
| 1,520,962 | 12/1924 | North | 2/2 |
| 2,696,617 | 12/1954 | Warchester | 2/102 |
| 3,055,133 | 9/1962 | Anderson | 40/129 |
| 4,106,121 | 8/1978 | Belson | 2/102 |
| 4,241,459 | 12/1980 | Quayle | 2/102 |
| 4,268,917 | 5/1981 | Massey | 2/102 |
| 4,275,513 | 6/1981 | Atonious | 2/DIG. 6 |
| 4,344,620 | 8/1982 | Debski | 2/2 |
| 4,382,302 | 5/1983 | Watson | 2/102 |

*Primary Examiner*—Doris L. Troutman

*Attorney, Agent, or Firm*—Calif Kip Tervo

[57] ABSTRACT

A snugly-fitting, variable-weight vest for wearing while exercising generally comprises a back panel, and left and right front panels connected to the back panel at their proximate top edges. The panels are of flexible material and are relatively short, having a length above the waist of a user. Elastic panels join the front and back panels along their respective side edges. The vest is fastened at the front with a plurality of straps to adjust the vest to conform to the user's body. Pockets on the panel receive weights which are shaped to snugly fit into the pockets. The weights are easily bendable by a wearer to conform to the wearer's body. A second embodiment employs horizontal pockets on the inside of the vest and padded weights. The vest is designed to fit snugly and conform to the user's body so that the weights do not move relative to the user's body during use.

11 Claims, 3 Drawing Figures

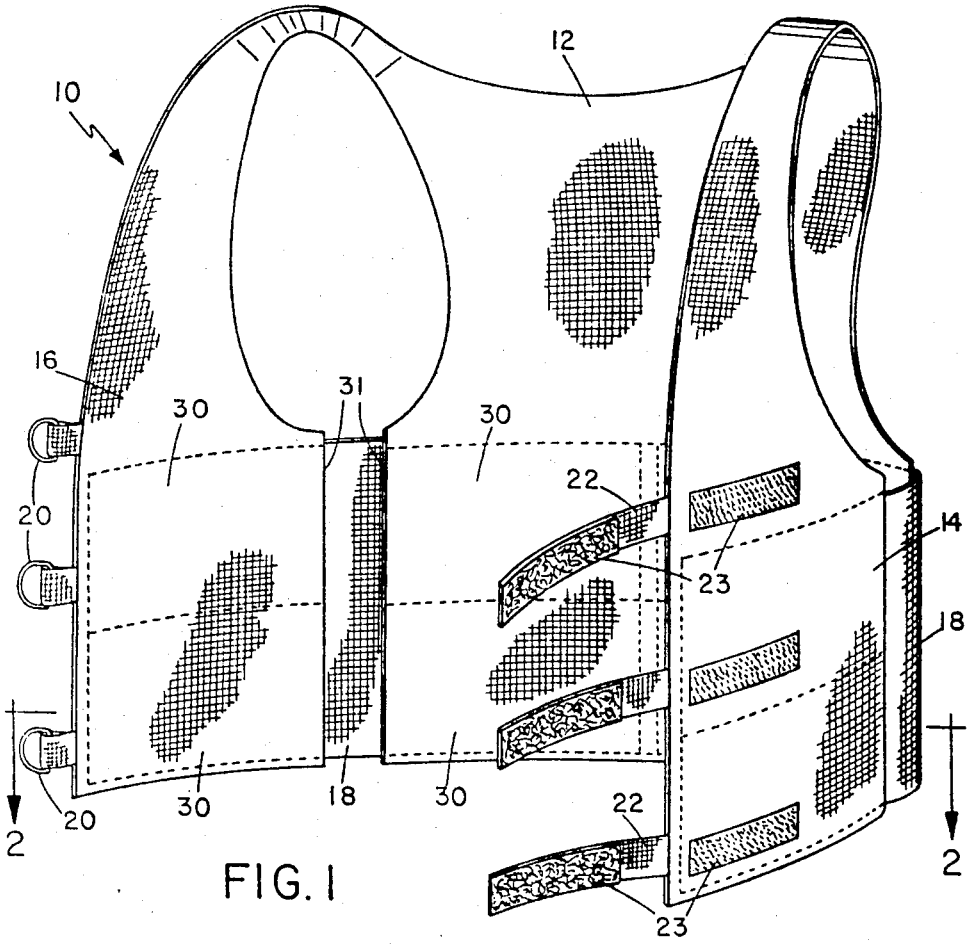
FIG. 1
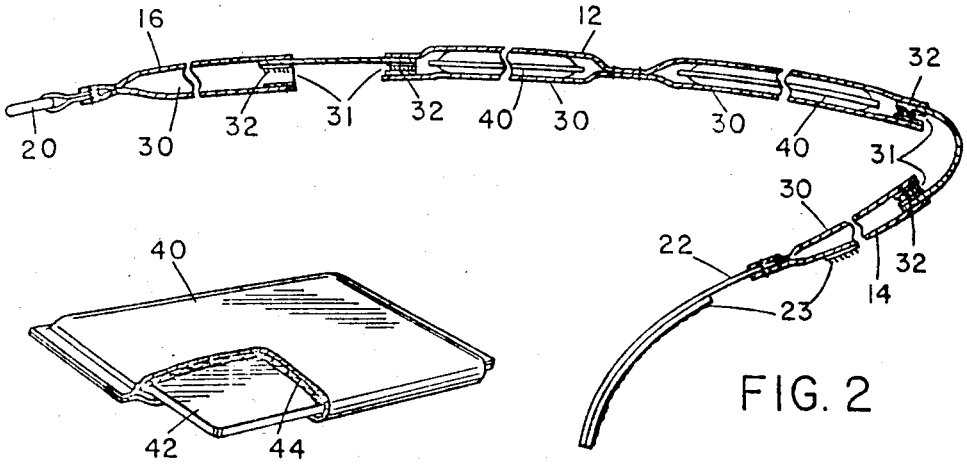
FIG. 2
FIG. 3

WEIGHT VEST

BACKGROUND OF THE INVENTION

1. Field of the Invention

This invention relates in general to a weight vest and more particularly to a weighted vest adapted to be worn by an athlete to increase running strength, speed and endurance.

2. Background of the Invention

It is well known that one of the best methods to develop greater speed and endurance in running is through use of added weight above the waist. Added weight above the waist imposes greater resistance upon the leg muscles as well as all of the other muscles that are involved in running, thus strengthening them. Also, this strengthening is accomplished while the athlete is moving, which provides a balanced increase in all of the running muscles, not just the development of specific muscles as with standard weight-training. However, conventional weighted training vests have several deficiencies which discourage most athletes from using them, and therefore, they have not found wide approval and use.

A major problem of most conventional vests is that the weights may move about dynamically while the athlete is moving, thereby throwing off the athlete's balance and rhythm. Moving weights may be the result of the vest being too loose fitting so that the whole vest bounces and otherwise swings about as the athlete moves, or the weights may be loose in large pockets and be able to move within the vest. In addition to disturbing the athlete3 s movement and balance, moving weights can cause chaffing and bruising.

Another drawback of many conventional weighted vests is that they are too long and restrict natural waist and upper body movement and may cause bruising and chaffing about the hips.

An additional shortcoming of some conventional vests is that with vigorous movement on behalf of the wearer, the weights shift position or even fall off or out of the vest. This can be disturbing at the least, and quite dangerous in some situations as the protruding weight may injure others. Additionally, some weight vests are not designed to easily alter the amount of weight used, particularly without exacerbation of one of the disadvantages discussed above.

Therefore, it is desirable to have an improved weighted training vest which will conform to the athlete's body and which will hold variable weights in a fixed position relative to the athlete's body.

It is further desirable that such a vest not restrict the natural upper body and waist movement of the athlete.

It is further desirable that the weighs be variable and be so restrained as to not be capable of movement within the vest or of falling out.

SUMMARY OF THE INVENTION

According to the invention, a snugly-fitting, variable-weight vest for wearing while exercising generally comprises a back panel, and left and right front panels of flexible material. The left and right front panels are connected to the back panel at their proximate top edges. The panels are all relatively short; their bottom edges designed to be above the waist of a user.

Elastic material joins the front panels to the back panel along their respective side edges. The front of the vest is fastened with a plurality of straps fastened to one front panel and passing through D-rings attached to the other front panel. The fastening straps may have Velcro, a trademark of DuPont, thereon for fastening to themselves or to the panel to which they are fastened. The front fasteners are in substantially the same horizontal plane as the elastic side panels.

Weights are shaped to snugly fit into the pockets.

According to a further precept of the invention, the weights are easily bendable by a wearer to conform to the wearer's body.

In the exemplary embodiment, the pockets on each panel are horizontal with the flapless opening adjacent the elastic side panels. In a further embodiment, the pockets and openings are on the inside of the panels.

Other features and many attendant advantages of the invention will become more apparent upon a reading of the following detailed description together with the drawings, in which like reference numerals refer to like parts throughout.

BRIEF DESCRIPTION OF THE DRAWING

FIG. 1 is a perspective view of the weight vest.

FIG. 2 is an enlarged sectional view of a pocket taken on line 2—2 of FIG. 1.

FIG. 3 is a perspective view, partially cut away, of a single weight.

DETAILED DESCRIPTION OF THE INVENTION

With reference now to the drawing, and more particularly to FIG. 1 thereof, there is shown a preferred embodiment of the snugly fitting variable-weight vest of the present invention, indicated generally as 10, comprising a back panel 12, left front panel 14, and right front panel 16. "Left" in this context refers to the side of the wearer's body covered by the panel.

The front panels 14, 16 are joined to the rear panel at their proximate top edges; thereby creating a support area over the user's shoulder for supporting the vest. The panels may be made of flexible material, such as nylon. The panels are short in length and designed to ride above a user's waist so as to allow for free waist movement and to avoid rubbing, bruising, or chaffing about the hips. In the preferred embodiment, the panels are made with two layers for strength and for forming weight-receiving pockets, as will later be described.

Elastic side joining means 18 elastically joins the front panels 14, 16 to rear panel 12 along their respective side edges under a user's arm. As shown in the preferred embodiment, the elastic side joining means is an elastic panel, but may be a plurality of elastic straps, or elastic mesh to increase the ventilating quality of the vest.

Front fastening means such as straps 22 and D-rings 20 are connected to the front panels for adjustably fastening the vest snuggly about a user. Straps 22 have mutually cooperating fastening means such as hook/-loop fastener material. It has been found that the plurality of closely-spaced straps 22, which can be quickly and easily adjusted, are ideally suited for working against the elastic sides, and snugging the vest to exactly conform to the user's body.

Horizontal pockets 30 for receiving weights are located in each panel. In the preferred embodiment the pockets are of uniform size for receiving weights of uniform size and configuration, which contributes to the overall simplicity of the invention. As shown in FIG. 1, pockets 30 in the left and right front panels 14, 16 traverse the entire panel. Back panel 12 has two vertical columns of horizontal pockets 30. This arrangement allows each pocket 30 to have an opening 31 along the edge of the panel. The pocket openings 31 are sealed to retain weights. As shown in FIG. 2, the pocket opening 31 is sealed with mutually cooperating fastening means such as hook/loop fastener material 32 located within the pocket. In this manner there are no pocket flaps, external fasteners, nor fastening material to rub against the user or other objects and cause damage or which can be accidentally opened. The columns of horizontal pockets, particularly on the front panels 14, 16, in conjunction with the horizontal front fastener, allows the vest to more closely conform to a wearer's body then would long vertically orientated pockets.

A typical pocket panel is shown in cross-section in FIG. 2. In its simplest form, the panels are comprised of two layers of material stitched together periodically to form multiple pockets. As can be seen, pocket 30 is rather long and flat without great depth. Weights are inserted into the panel through opening 31 and the hook/loop fastener material 32 on the inside surface of pocket 30 is sealed to retain the weight.

FIG. 3 illustrates an exemplary embodiment of a weight, shown generally as 40, for use with the vest 10. Weight 40 generally comprises a central core of extremely dense material, such as lead or lead alloy 42, surrounded by a padded coating 44. The lead alloy 42, although very dense and therefore heavy, is relatively soft, and is in a relatively thin sheet so that a user may quite easily bend the weight to specifically conform to the shape of the user's body. The weight may be padded such as with soft rubber or with nylon coated foam 44 to provide greater resilience between a user an the weight. The padding also protects the lead alloy 42 from damage such as small nicks and cuts due to handling. In the alternative, the pockets could be padded. Weights 40 are configured to snugly fit within and entirely fill each pocket. Smaller weights may require additional padding 44 to entirely fill a pocket. Preferably the pockets and weights are of standardized dimension to allow for easy replacement and substitution. Because the pockets have no exposed flaps or fastening material to cause abrasion, the vest 10 may be worn with the pockets on the inside adjacent the user. This has been found to aid in preventing vest movement during exercise and to positively prevent the weights from escaping from the pockets.

From the foregoing description it is seen that the present invention provides an improved weight vest for conditioning athletes. Of course the vest may also be used for the therapeutic treatment of many circulatory disfunctions and for generally increasing cardiovascular strength.

Although a particular embodiment of the invention has been illustrated and described, modifications and changes will become apparent to those skilled in the art, and it is intended to cover in the appended claims, such modifications and changes as come within the true spirit and scope of the invention.

We claim:

1. A snugly fitting variable weight vest for wearing while exercising comprising:
   - a back panel;
   - left and right front panels connected to said back panel at their proximate top edges; said panels being of flexible material and being above the waist of a user; each panel having an inside and an outside;
   - elastic side joining means for elastically joining said front panels to said back panel along their respective side edges;
   - front fastening means connected to said left and right front panels for adjustably fastening said vest snugly about a user;
   - pockets on said panels; said pocket having an opening;
   - closing means for closing said pockets; and
   - weights; each weight shaped to snugly fit in a said pocket; said weights being easily bendable by a wearer to conform to the shape of a wearer's body.

2. The vest of claim 1 wherein said pockets are uniform in size.

3. The vest of claim 1 wherein said pocket closing means is mutually-cooperative on the inside of said pocket adjacent the opening such that a smooth material surface is presented to the user.

4. The vest of claim 1 wherein said weights are padded.

5. A snugly fitting variable weight vest for wearing while exercising comprising:
   - a back panel;
   - left and right front panels connected to said back panel at their proximate top edges; said panels being of flexible material and being above the waist of a user; each panel having an inside and an outside;
   - elastic side joining means for elastically joining said front panels to said back panel along their respective side edges;
   - front fastening means connected to said left and right front panels for adjustably fastening said vest snugly about a user;
   - horizontal pockets on each panel; said pockets having an opening for insertion of a weight;
   - sealing means for sealing said pockets; and
   - weights dimensioned to snugly fit in said pockets; said weights being easily bendable by a wearer to conform to the wearer's body.

6. The vest of claim 5 wherein said weights are padded.

7. The vest of claim 6 wherein said pockets are of uniform size.

8. The vest of claim 7 wherein said sealing means comprises mutually-cooperating means within the pocket adjacent the opening such that a smooth material surface is presented to a user.

9. The vest of claim 6 wherein said pockets are on the inside of said panels so that said weights cannot escape from said pockets while said vest is in use.

10. A snugly fitting variable weight vest for wearing while exercising comprising:
   - a back panel;
   - left and right front panels connected to said back panel at their proximate top edges; said panels being of flexible material and being above the waist of a user; each panel having an inside and an outside;
   - elastic side joining means for elastically joining said front panels to said back panel along their respective side edges;
   - front fastening means connected to said left and right front panels for adjustably fastening said vest snugly about a user;
   - pockets on the inside of said panels; said pocket having an opening;
   - closing means for closing said pockets; and
   - weights; each weight shaped to snugly fit in a said pocket; said weights being easily bendable by a wearer to conform to the wearer's body.

11. The vest of claim 10 wherein said weights are padded.

* * * * *